US011408221B2

(12) United States Patent
Dreyer et al.

(10) Patent No.: US 11,408,221 B2
(45) Date of Patent: Aug. 9, 2022

(54) ENTRANCE SYSTEM

(71) Applicant: Assa Abloy Entrance Systems AB, Landskrona (SE)

(72) Inventors: Roger Dreyer, Bjarred (SE); Rebeca Homssi, Landskrona (SE)

(73) Assignee: Assa Abloy Entrance Systems AB, Landskrona (SE)

( * ) Notice: Subject to any disclaimer, the term of this patent is extended or adjusted under 35 U.S.C. 154(b) by 0 days.

(21) Appl. No.: 17/054,370

(22) PCT Filed: May 16, 2019

(86) PCT No.: PCT/EP2019/062574
§ 371 (c)(1),
(2) Date: Nov. 10, 2020

(87) PCT Pub. No.: WO2019/219794
PCT Pub. Date: Nov. 21, 2019

(65) Prior Publication Data

US 2021/0189787 A1 Jun. 24, 2021

(30) Foreign Application Priority Data

May 18, 2018 (SE) ..... 1830164-8

(51) Int. Cl.
*E05F 15/73* (2015.01)
*E05F 15/79* (2015.01)

(52) U.S. Cl.
CPC ..... *E05F 15/73* (2015.01); *E05F 15/79* (2015.01); *E05Y 2900/132* (2013.01)

(58) Field of Classification Search
CPC . E05F 15/73; E05F 15/79; E05F 15/43; E05F 15/77; E05F 15/00; E05F 15/40;
(Continued)

(56) References Cited

U.S. PATENT DOCUMENTS 1,773,243 A 8/1930 Stewart
4,967,083 A * 10/1990 Kornbrekke ..... E05F 15/43 250/341.7

(Continued)

OTHER PUBLICATIONS

International Search Report and Written Opinion mailed in PCT/EP2019/062574 dated Sep. 3, 2019 (13 pages).
Swedish Search Report in 1830164-8 dated Nov. 15, 2018.

*Primary Examiner* — Justin B Rephann
(74) *Attorney, Agent, or Firm* — Wissing Miller LLP

(57) ABSTRACT

Present invention relates to an entrance system (10) comprising a control arrangement (20) for controlling the automatic door operator (30). The entrance system (10) is configured to operate in any one of the following states: an opening state (OPS) wherein the one or more movable door members (D1 . . . Dm) are moving between the closed position and the opened position towards the opened position; a closing state (CLS) wherein the one or more movable door members (D1 . . . Dm) are moving between the opened position and the closed position towards the closed position. The control arrangement is configured to receive an opening command prompting the entrance system to be in the opened state (OS) and in response to the opening command, control the automatic door operator (30) to cause the entrance system (10) to switch to the opened state (OS) and select a first predetermined keep open time (TK1) as a current keep open time (TC) for which the entrance system shall be kept in the opened state (OS) and receive sensor data from the at least one sensor (S1 . . . Sn) and in response to the sensor data indicating that no person or object is passing through the entrance system, select a second predetermined keep open time (TK2) as the current keep open time (TC). Present invention further relates to a control arrangement for an entrance system (10) and a method for operating said entrance system (10).

13 Claims, 5 Drawing Sheets

(58) Field of Classification Search
CPC .. E05F 15/434; E05F 15/60; E05Y 2400/354; E05Y 2400/45; E05Y 2900/132
See application file for complete search history.

(56) References Cited

U.S. PATENT DOCUMENTS

| | | | | |
|---|---|---|---|---|
| 5,142,152 | A | 8/1992 | Boiucaner | |
| 5,453,736 | A | 9/1995 | Noren | |
| 6,525,659 | B2 | 2/2003 | Jaffe et al. | |
| 7,045,764 | B2 * | 5/2006 | Beggs | E06B 9/13 250/221 |
| 9,341,013 | B2 * | 5/2016 | Iwata | E05F 15/73 |
| 2005/0224700 | A1 * | 10/2005 | Petra | E06B 9/88 250/221 |
| 2007/0214725 | A1 * | 9/2007 | Miyashita | E05F 15/79 49/340 |
| 2011/0227746 | A1 * | 9/2011 | Houser | E05F 3/222 340/686.1 |
| 2013/0081329 | A1 | 4/2013 | French | |
| 2013/0127590 | A1 | 5/2013 | Braverman et al. | |
| 2016/0024831 | A1 | 1/2016 | Houser et al. | |
| 2017/0016259 | A1 * | 1/2017 | Schweiss | E06B 3/483 |
| 2018/0363358 | A1 * | 12/2018 | Hudson | E05F 15/73 |
| 2019/0218847 | A1 * | 7/2019 | Agam | G01S 17/894 |

* cited by examiner

ENTRANCE SYSTEM

This application is a 371 of PCT/EP2019/062574 filed on May 16, 2019, published on Nov. 21, 2019 under publication number WO 2019/219794, which claims priority benefits from Swedish Patent Application No. 1830164-8, filed on May 18, 2018, the disclosure of which is incorporated herein by reference.

TECHNICAL FIELD

The present invention relates to the technical field of entrance systems having one or more movable door members. Also, the present invention relates to a control arrangement for an entrance system having one or more movable door members and an automatic door operator for causing movements of the one or more movable door members between closed and open positions. The present invention also relates a method of operating such an entrance system and a control arrangement for such an entrance system.

BACKGROUND

Entrance systems having manual doors, doors with door closers or automatic doors can be found in various buildings today. Such entrance systems allow access to the building for pedestrians while also enabling a desirable indoor climate and temperature inside the building.

With the increased occurrence of advanced and automated indoor climate systems, ventilations systems and air conditions system air infiltration causes severe increases in energy consumption in the building due to the system attempting to regulate the indoor temperature and/or climate to counteract the infiltrating air.

A door system with a door being held open for long period of times forces the aforementioned systems to compensate for the influx of infiltrating air passing through the open doorway. This results in a significant increase in energy consumption leading to higher costs for the building owners as well as a higher environmental impact.

In the field of for example automated or automatic entrance system the most severe energy losses are associated with the door being opened due to the increase in energy consumption connected to the consequential regulating of the indoor climate and temperature.

A conventional entrance system with a manual door requires the operator to close the door manually in order to reduce the influx of infiltrating air. In a busy environment with a large number of pedestrians passing through the door, the risk for the door being held at an opened position for long periods of time is especially present.

To decrease the time the door is kept open and reduce the need for manual closing, manual doors has traditionally been equipped with automated door closers. The door closer may be set to cause the closing of the door after the door has been in an opened state for a predetermined time period.

Entrance systems having automatic door operators are frequently used for providing automatic opening and closing of one or more movable door members in order to facilitate entrance and exit to buildings, rooms and other areas. The door members may for instance be swing doors, sliding door or revolving doors. Further the door members may be garage doors, sectioned doors, overhead doors or high-speed doors (i.e. vertically moving doors).

Since entrance systems having automatic door operators are typically used in public areas, user convenience is important. The entrance systems need to remain long-term operational without malfunctions even during periods of heavy traffic by persons or objects passing through the entrance systems. At the same time, safety is crucial in order to avoid hazardous situations where a present, approaching or departing person or object (including but not limited to animals or articles brought by the person) may be hit or jammed by any of the movable door members.

Entrance systems are therefore typically equipped with a control arrangement including a controller and one or more sensor units, where each sensor unit is connected to the controller and is arranged to monitor a respective zone at the entrance system for presence or activity of a person or object. In order to provide user convenience and long-term operational stability and at the same time prevent injuries or damages to present, approaching or departing persons or objects, it is of paramount importance that the sensor units provide accurate output signals to the controller. The controller, which may be part of the automatic door operator or a separate device, controls the operation of the automatic door operator—and therefore the automatic opening and closing of the movable door members—based on the output signals from the sensor units. If a sensor unit fails to provide an output signal to the controller when a person or object should have been detected, there is an apparent risk for injuries or damages. Conversely, if a sensor unit provides "false alarm" output signals to the controller in situations where rightfully nothing should have been detected, then there is an apparent risk that the controller will command the automatic door operator to stop or block the automatic opening or closing of the movable door members and hence cause user annoyance or dissatisfaction.

The sensor units typically comprise active/passive infrared sensors/detectors, radar/microwave sensors/detectors, image-based sensors/detectors, or combinations thereof.

In response to the sensor signals from the sensor units the doors may open and close automatically when someone is approaching. In prior art entrance systems, safe passage through the door is ensured by said door being held open for a certain time period to allow the approaching person to walk through.

Similar to doors with automated door closers, entrance systems with automatic door operators still are held in an open state at a predetermined time before closing. Alternatively, the time period is held in an open state may be controlled based on the input of presence sensors of the entrance system.

Although the position of the door of the entrance system open state may be altered in order to reduce the area allowing for passage of infiltrating air, the door is still kept in open state for a set time before closing. This also allows for infiltrating air to enter through the entrance system and negatively impact the energy consumption of the building.

The present inventor has realized that there is room for improvement in this field.

SUMMARY

An object of the present invention is therefore to provide one or more improvements in the field of entrance systems having automatic door operators for causing movements of one or more movable door members between closed and open positions.

Accordingly, a first aspect of the present invention is an entrance system comprising one or more movable door members, an automatic door operator for causing movements of the one or more movable door members between a closed position and an opened position. The closed and opened position corresponds to a closed state and an opened state of the entrance system, respectively. The entrance system further comprises a control arrangement for controlling the automatic door operator. The control arrangement comprises a controller and at least one sensor. Each sensor is connected to the controller and configured to monitor a respective zone at the entrance system for presence or activity of at least one person or object. The at least one sensor is configured to detect a person or object passing through the entrance system through the respective zone. Said at least one sensor is configured to generate an active presence impulse while a person or object is detected in the respective zone and an inactive presence impulse while no person or object is detected in said respective zone.

The entrance system is configured to operate in an opening state wherein the one or more movable door members are moving between the closed position and the opened position towards the opened position and a closing state. The one or more movable door members are moving between the opened position and the closed position towards the closed position.

The control arrangement is configured to receive an opening command. The opening command prompts the entrance system to be in the opened state. In response to the opening command, the control arrangement is configured to control the automatic door operator to cause the entrance system to switch to the opened state and select a first predetermined keep open time as a current keep open time for which the entrance system as a minimum shall be kept in the opened state.

The control arrangement is further configured to receive an active or inactive presence impulse from the at least one sensor configured to detect a person or object passing through the entrance system through the respective zone. In response to receiving an inactive presence impulse, the control arrangement is configured to select a second predetermined keep open time as the current keep open time. The second predetermined keep open time is substantially shorter than the first predetermined keep open time.

The control arrangement is also configured to control the automatic door operator to keep the entrance system in the opened state for the current keep open time and if no active presence impulse and no opening command has been received during said current keep open time, cause the automatic door operator to switch from the opened state (OS) to the closing state after said current keep open time.

According to a second aspect a control arrangement for an entrance system is provided. The entrance system has one more movable door members and an automatic door operator for causing movements of the one or more movable door members between a closed position and an opened position corresponding to a closed state and an opened state of the entrance system, respectively.

The control arrangement comprises a controller and at least one sensor. Each sensor is connected to the controller and configured to monitor a respective zone at the entrance system for presence or activity of at least one person or object. The at least one sensor is configured to detect a person or object passing through the entrance system through the respective zone. Said at least one sensor is configured to generate an active presence impulse while a person or object is detected in the respective zone and an inactive presence impulse while no person or object is detected in said respective zone.

The entrance system is configured to operate in an opening state wherein the one or more movable door members are moving between the closed position and the opened position towards the opened position and a closing state. The one or more movable door members are moving between the opened position and the closed position towards the closed position.

The control arrangement is configured to receive an opening command prompting the entrance system to be in the opened state. In response to the opening command, the control arrangement is configured to control the automatic door operator to cause the entrance system to switch to the opened state and select a first predetermined keep open time as a current keep open time for which the entrance system as a minimum shall be kept in the opened state.

Further, the control arrangement is configured to receive an active or inactive presence impulse from the at least one sensor configured to detect a person or object is passing through the entrance system through the respective zone and in response receiving an inactive presence impulse, select a second predetermined keep open time as the current keep open time. The second predetermined keep open time is substantially shorter than the first predetermined keep open time.

The control arrangement is further configured to control the automatic door operator to keep the entrance system in the opened state for the current keep open time and if no active presence impulse and no opening command has been received during said current keep open time, cause the automatic door operator to switch from the opened state to the closing state after said current keep open time.

According to an aspect a method of operating an entrance system is provided. The entrance system has one or more movable door members and an automatic door operator for causing movements of the one or more movable door members between a closed position and an opened position. Said positions corresponds to a closed state and an opened state of the entrance system, respectively.

The entrance system is further configured to operate in an opening state wherein the one or more movable door members are moving between the closed position and the opened position towards the opened position and a closing state wherein the one or more movable door members are moving between the opened position and the closed position towards the closed position.

The entrance system comprises a control arrangement for controlling the automatic door operator. The control arrangement comprises a controller and at least one sensor. Each sensor is connected to the controller and is configured to monitor a respective zone at the entrance system for presence or activity of at least one person or object. The at least one sensor is configured to detect a person or object passing through the entrance system through the respective zone. Said at least one sensor is configured to generate an active presence impulse while a person or object is detected in the respective zone and an inactive presence impulse while no person or objet is detected in said respective zone.

The method comprises steps according to the following.

Receiving an opening command prompting the entrance system to be in the opened state.

In response to the opening command controlling the automatic door operator to cause the entrance system to switch to the opened state and selecting a first predetermined keep open time as a current keep open time for which the entrance system as a minimum shall be kept in the opened state.

Receiving an active or inactive presence impulse from the at least one sensor configured to detect a person or object passing through the entrance system through the respective zone.

In response to receiving an inactive presence impulse, selecting a second predetermined keep open time as the current keep open time. The second predetermined keep open time is substantially shorter than the first predetermined keep open time.

Controlling the automatic door operator to keep the entrance system in the opened state for the current keep open time and if no active presence impulse and no opening command has been received during said current keep open time, causing the automatic door operator to switch from the opened state to the closing state after said current keep open time.

Embodiments of the invention are defined by the appended dependent claims and are further explained in the detailed description section as well as in the drawings.

It should be emphasized that the term "comprises/comprising" when used in this specification is taken to specify the presence of stated features, integers, steps, or components, but does not preclude the presence or addition of one or more other features, integers, steps, components, or groups thereof. All terms used in the claims are to be interpreted according to their ordinary meaning in the technical field, unless explicitly defined otherwise herein. All references to "a/an/the [element, device, component, means, step, etc]" are to be interpreted openly as referring to at least one instance of the element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

Objects, features and advantages of embodiments of the invention will appear from the following detailed description, reference being made to the accompanying drawings.

DETAILED DESCRIPTION OF EMBODIMENTS

Figure 1:
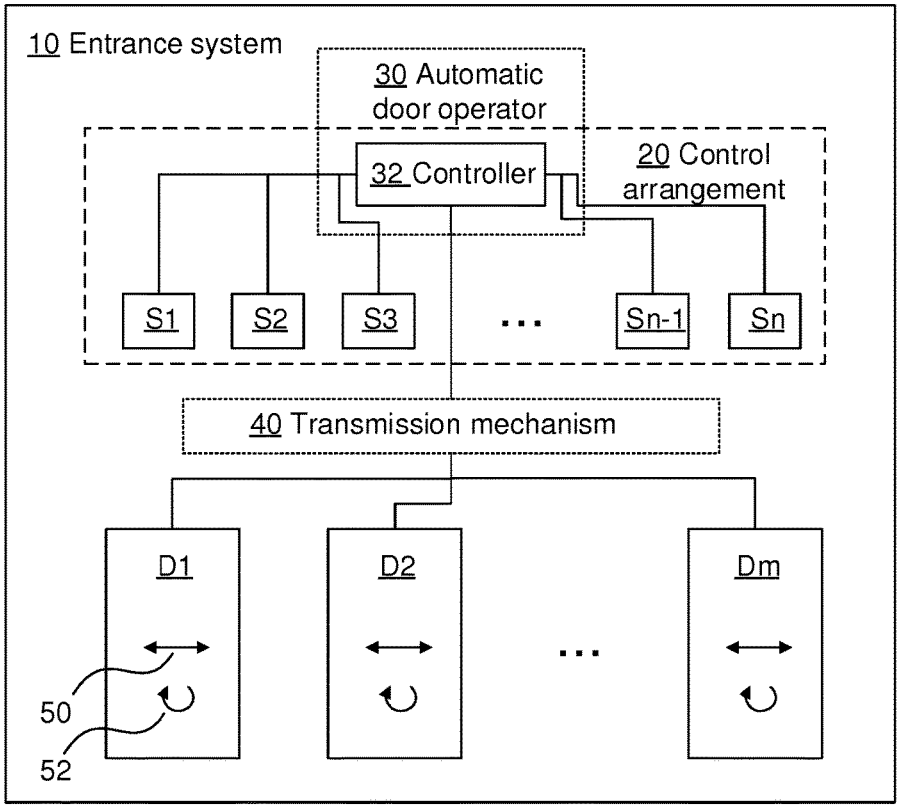
FIG. 1 is a schematic block diagram of an entrance system generally according to the present invention.

Embodiments of the invention will now be described with reference to the accompanying drawings. The invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the particular embodiments illustrated in the accompanying drawings is not intended to be limiting of the invention. In the drawings, like numbers refer to like elements.

Figure 2:
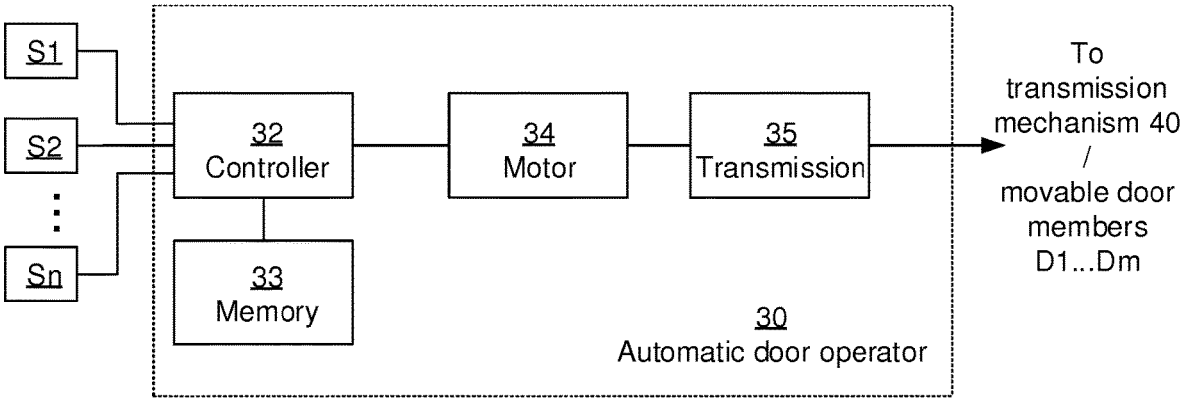
FIG. 2 is a schematic block diagram of an automatic door operator which may be included in the entrance system shown in FIG. 1.

FIG. 1 is a schematic block diagram illustrating an entrance system 10 in which the inventive aspect of the present invention may be applied. The entrance system 10 comprises one or more movable door members D1 . . . Dm, and an automatic door operator 30 for causing movements of the door members D1 . . . Dm between closed and open positions. In FIG. 1, a transmission mechanism 40 conveys mechanical power from the automatic door operator 30 to the movable door members D1 . . . Dm. FIG. 2 illustrates one embodiment of the automatic door operator 30 in more detail.

Pursuant to the invention, a control arrangement 20 is provided for the entrance system 10. The control arrangement 20 comprises a controller 32, which may be part of the automatic door operator 30 as seen in the embodiment of FIG. 2, but which may be a separate device in other embodiments. The control arrangement 20 also comprises a plurality of sensors S1 . . . Sn. Each sensor is connected to the controller 32 by wired connections, wireless connections, or any combination thereof. As will be exemplified in the subsequent description of the two different embodiments in FIGS. 5 and 6, each sensor is configured to monitor a respective zone Z1 . . . Zn at the entrance system 10 for presence or activity of at least one person or object. The person may be an individual who is present at the entrance system 10, is approaching it or is departing from it. The object may, for instance, be an animal or an article in the vicinity of the entrance system 10, for instance brought by the aforementioned individual.

Said zones Z1 . . . Zn may be disposed so as to enable monitoring of persons or objects about to enter the entrance system 10 from both directions, i.e. both from the inside and outside, as well as persons or objects passing through the entrance system.

The embodiment of the automatic door operator 30 shown in FIG. 2 will now be described in more detail. The automatic door operator 30 may typically be arranged in conjunction with a frame or other structure which supports the door members D1 . . . Dm for movements between closed and open positions, often as a concealed overhead installation in or at the frame or support structure.

In addition to the aforementioned controller 32, the automatic door operator 30 comprises a motor 34, typically an electrical motor, being connected to an internal transmission or gearbox 35. An output shaft of the transmission 35 rotates upon activation of the motor 34 and is connected to the external transmission mechanism 40. The external transmission mechanism translates the motion of the output shaft of the transmission 35 into an opening or a closing motion of one or more of the door members D1 . . . Dm with respect to the frame or support structure.

The controller 32 is configured for performing different functions of the automatic door operator 30 in the different operational states of the entrance system 10, using inter alia sensor input data from the plurality of sensors S1 . . . Sn. Hence, the outputs of the plurality of sensors S1 . . . Sn are connected to data inputs of the controller 32. At least some of the different functions performable by the controller 32 have the purpose of causing desired movements of the door members D1 . . . Dm. To this end, the controller 32 has at least one control output connected to the motor 34 for controlling the actuation thereof. Further the controller 32 may comprise a timer, as is well known for a person skilled in the field.

The sensors may for example be time of flight sensors, IR-sensors, radar (microwave) sensors.

The sensors may be configured to monitor for example zones adapted to cover the entrance to the entrance system from both sides of the entrance system 10 and the area of the entrance system covering the trajectory of the one or more movable door members D1 . . . Dm i.e. the opening and/or the closing trajectory of the one or more movable door members D1 . . . Dm. The positioning of the zones will be further described with reference to a first and second embodiment in the form of a sliding door system and a swing door system.

The controller 32 may be implemented in any known controller technology, including but not limited to micro-controller, processor (e.g. PLC, RPU, DSP), FPGA, ASIC or any other suitable digital and/or analog circuitry capable of performing the intended functionality.

The controller 32 also has an associated memory 33. The memory 33 may be implemented in any known memory technology, including but not limited to E(E)PROM, S(D) RAM or flash memory. In some embodiments, the memory 33 may be integrated with or internal to the controller 32. The memory 33 may store program instruction for execution by the controller 32, as well as temporary and permanent data used by the controller 32.

The automatic door operator 30 is for causing movements of the one or more movable door members D1 . . . Dm between a closed position and an opened position. With advantage said automatic door operator 30 is configured to cause movements of the one or more movable door members D1 . . . Dm between their said closed position and opened position and vice versa.

Said closed position and opened position corresponds to a closed state CS and an opened state OS of the entrance system, respectively. The closed state CS of the entrance system 10 thus represents a state where the one or more movable door members D1 . . . Dm are positioned so as to seal the entrance system 10. In the closed state CS, the automatic door operator 30 holds the one or more movable door members D1 . . . Dm in their closed position.

Correspondingly, the opened state of the entrance system 10 thus represents a state where the one or more movable door members D1 . . . Dm are positioned so as to provide access through the entrance system 10, i.e. a state which facilitates passage through said entrance system 10.

Accordingly, the one or more movable door members D1 . . . Dm are configured to be held at the opened position in the opened state OS for allowing access through the entrance system 10. In the opened state OS, the automatic door operator 30 holds the one or more movable door members D1 . . . Dm in their open position.

Correspondingly, the one or more movable door members D1 . . . Dm are configured to be held at the closed position in the closed state CS for sealing the entrance system 10. As is recognizable for the skilled person, such a closed state would imply that little or no air infiltration takes place through the entrance system 10.

Further, the entrance system 10 is configured to operate in an opening state OPS and a closing state CLS. Said states occurs in the transition between the closed state and opened state and vice versa, whereby said states are caused by the automatic door operator 30 controlled by the control arrangement 20.

In the opening state OPS, the one or more movable door members D1 . . . Dm are moving between the closed position and the opened position towards the opened position. In said opening state OPS, the automatic door operator moves said one or more movable door members D1 . . . Dm towards their open position from their closed position.

In the closing state CLS, the one or more movable door members D1 . . . Dm are moving between the opened position and the closed position towards the closed position. In said closing state CLS, the automatic door operator moves said one or more movable door members D1 . . . Dm towards their closed position from their open position.

The opening and closing states represent transition states of the entrance system. Thus, the movable door members D1 . . . Dm are held stationary in a position where passage is enabled/prohibited through the entrance system 10 in the opened state and closed state respectively.

Notably, the opened state and closed state does not necessarily need to be the end positions in the trajectory of the movable door members as provided by the automatic door operator or the frame of the entrance system 10 or other dimensional or functional limitations. As is conventional, the opened state and closed state may correspond to both said end positions of the trajectory of the movable door members and other predefined positions along said trajectory where the movable door members may be held stationary in position.

As is known to the skilled person, the door operator may comprise at least one sensing element (not shown) for sensing the position of the one or more movable door members. In one embodiment, the at least one sensing element may be an encoder which may be arranged in connection with the motor of the automatic door operator. In one embodiment, the at least one sensor may be a position sensor mounted to the at least one movable door member.

Hence, the control arrangement 20 may be configured to cause the entrance system 10 to switch between above described states of the entrance system based on positional data from the at least one sensing element.

At least one sensor S1 . . . Sn is configured to monitor a respective zone Z1 . . . Zn at the entrance system 10 for presence or activity of at least one person or object. The at least one sensor S1 . . . Sn is configured to detect a person or object passing through the entrance system 10 through the respective zone Z1 . . . Zn. Said at least one sensor may be further configured to generate an active presence impulse while a person or object is detected in the respective zone Z1 . . . Zn. Correspondingly, said at least one sensor may be further configured to generate an inactive presence impulse while no person object is detected in said respective zone Z1 . . . Zn. Worded differently, said at least one sensor may be configured to generate a first continuous signal in response to a person or object being detected in the respective zone Z1 . . . Zn and a second continuous signal in response to no person or object being detected in the respective zone Z1 . . . Zn.

The controller 32 may be configured to receive presence impulses from the at least one sensor. The control arrangement 20 may thus be configured to control the automatic door operator based on the presence impulses received by the controller.

Figure 3A:
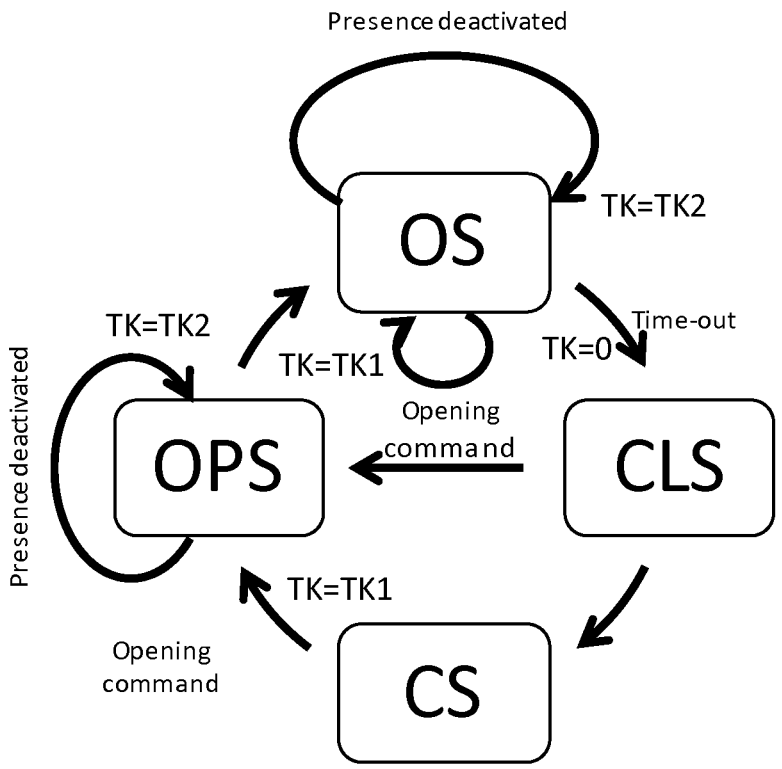
FIG. 3*a* is a flow chart diagram of the operation of the entrance system shown in FIG. 1.
Figure 3B:
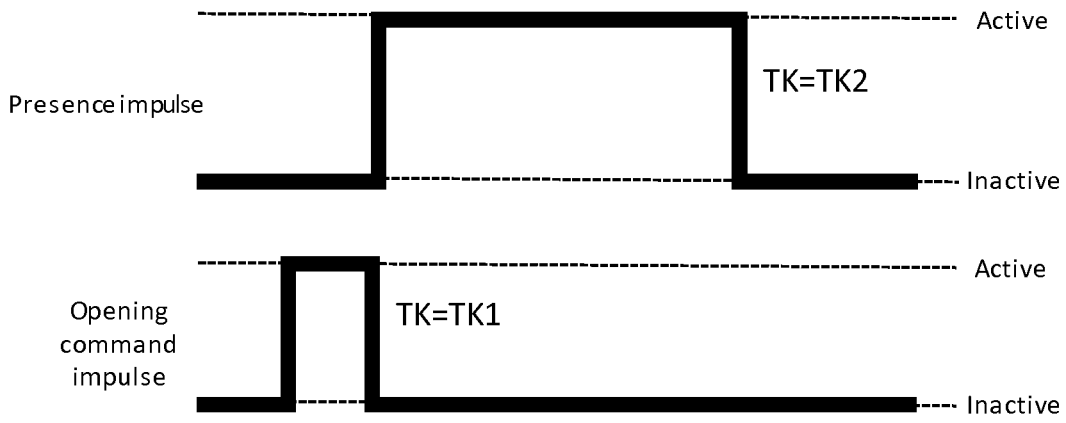
FIG. 3*b* is a diagram depicting the operation of the entrance system shown in FIG. 1.

FIG. 3*a-b* discloses a charts and diagrams describing the overall functionality of an entrance system according to the present invention.

To minimize influx of air, the control arrangement is configured to perform a sequence intelligently minimizing the time entrance system is allowing air to pass through. Hence, the control arrangement 20 is configured to receive an opening command prompting the entrance system to be in the opened state OS. In response to the opening command, the control arrangement 20 is further configured to control the automatic door operator 30 to cause the entrance system 10 to switch to the opened state OS and select a first predetermined keep open time TK1 as a current keep open time TC for which the entrance system as a minimum shall be kept in the opened state OS. Thus, the current keep open time is herein not defined as a fix timing for when the opened state shall be switched to the closing state. The entrance system may be kept in the opened state for a longer period of time if active presence impulses are generated or active presence impulses are received. Said current keep open time TC may be considered as the time which the entrance system shall be kept in the opened state (OS) if no additional opening commands or no active presence impulses are received, e.g. are received during the same time period.

The control arrangement 20 is configured to receive an active or inactive presence impulse from the at least one sensor S1 . . . Sn, e.g. the sensor configured to detect a person or object passing through the entrance system 10 through the respective zone Z1 . . . Zn. In response to receiving an inactive presence impulse, the control arrangement 20 is configured select a second predetermined keep open time TK2 as the current keep open time TC. The second predetermined keep open time TK2 is substantially shorter than the first keep open time TK1.

To enable faster closing of the door, the control arrangement 20 is configured to keep the entrance system 10 in the opened state OS for the current keep open time TC and if no active presence impulse and no opening command has been received during said current keep open time TC, cause the automatic door operator 30 to switch from the opened state OS to the closing state CS after said current keep open time TC., e.g. the keep open time currently selected. This is performed if the sensor data obtained from the at least one sensor S1 . . . Sn indicates that no person or object is passing through the entrance system and no additional opening commands are received. E.g., if the sensor data obtained from the at least one sensor S1 . . . Sn indicates that no person or object is passing through the entrance system and no additional opening commands are received during the current keep open time TC.

This allows for a faster closing of the door as soon as no person or object requiring access through the entrance system is present. The entrance system is particularly advantageous in situations where multiple person are passing through the entrance system. In a conventional entrance system, each person about to pass the entrance system will trigger an opening command associated with a predefined keep open time period which is stored in the controller of the door. This will result in the door keeping open for long accumulated stretches of times even when the person triggering the opening of the door has passed through the entrance system. The entrance system according to the present invention allows for the door to close faster as soon as nothing indicates that a person nearby is attempting to access the entrance system, thereby potentially reducing the time which the door is kept open. This results in less air influx through the entrance system and a lesser energy consumption for the building which the entrance system is installed in.

Compared to controlling the speed or opening degree of the door to reduce air infiltration through the entrance system, the above described functionality does not require complex programming or additional components to be functional. Hence, the functionality described with reference to the entrance system of the present invention can easily be implemented and retrofitted to existing entrance systems without a complex installation being required.

Notably, the entrance system 10 may be in any state when receiving the opening command. Hence, the opening command may be received also when the entrance system already is in the opened state or when movable door members are moving from or towards their opened position, e.g. in the opening and closing state or when the entrance system is in the closed state.

The first predetermined keep open time may thus represent a normal operation keep open time. The normal keep open time is utilized if a person or objects moves slowly through the entrance system. In such a situation the active presence impulse is generated throughout the entire passing through the entrance system, whereby the second predetermined keep open time is not selected unless the person or object is able to pass through the entrance system before the normal keep open time has passed from the moment where the entrance system enters the opened state OS.

In one embodiment, the opening command may be in the form of an opening command impulse, as depicted in FIG. 3*b*.

In one embodiment, the first predetermined keep open time TK1 may be between 10 and 20 seconds, more preferably about 15 seconds. In one embodiment, the second predetermined keep open time may be between 1 and 5 seconds, more preferably between 1 and 2 seconds.

In one embodiment, said first and second predetermined keep open time are stored in the memory 33. Thus the control arrangement may be further configured to obtain said first and second predetermined keep open time period prior to selecting them.

In one embodiment, the controller 32 of the control arrangement comprises a timer, whereby the control arrangement 20 is configured to control the automatic door operator based on the input of said time.

In one embodiment, the controller 32 is configured to receive the sensor data obtained from the at least one sensor S1 . . . Sn. In one embodiment, the controller 32 is configured to receive the active and inactive presence impulse from said at least one sensor S1 . . . Sn.

In one embodiment, the at least one sensor S1 . . . Sn configured to detect a person or object passing through the entrance system through the respective zone Z1 . . . Zn is at least one door presence sensor. The at least one presence sensor is configured to monitor a zone representing a passage zone through the entrance system. Such a presence sensor is generally known as a safety sensor.

In one embodiment, multiple sensors S1 . . . Sn may be configured to cooperate to detect a person or object passing through the entrance system through respective zones Z1 . . . Zn. In one embodiment a first sensor is configured to detect a person or object in passage zone from a first side of the entrance system and a second sensor is configured to detect a person or object in a passage zone from a second side, e.g. an opposite side. The sensors may be configured to in concert generate an active presence impulse if a person or object is present in any of the passage zones by any of the sensors. Similarly, the sensors may configured to in concert generate an inactive presence impulse if no person or object is present in any of the passage zones by the sensors.

In one embodiment, if an active presence impulse is received when the entrance system 10 is kept in the opened state OS during the current keep open time (TC), the control arrangement 20 may be configured to cause the automatic door operator 30 to maintain the entrance system in the opened state OS while receiving the active presence impulse. In response to subsequently receiving an inactive presence impulse, e.g. when receiving an inactive presence impulse instead of an active presence impulse or when the inactive presence impulse is replaced with an active presence impulse, the control arrangement 20 may be configured to select the second predetermined keep open time TK2 as the current keep open time TC. Subsequently, e.g. in response to selecting said second predetermined keep open time TK2 as the current keep open time TC, the control arrangement is configured to cause the automatic door operator 30 to keep the entrance system 10 in the opened state OS for the current keep open time TC. Thus, the control arrangement is configured to after selecting the second predetermined keep open time TK2 as the current keep open time TC cause said operator to keep the entrance system in said opened state OS (for the current keep open time TC). Identical to what is described above, if no active presence impulse and no opening command has been received during said current keep open time (TC), the control arrangement 20 may be configured to cause the automatic door operator (30) to switch from the opened state (OS) to the closing state (CS) after said current keep open time (TC). Accordingly, the additional persons or objects entering through the entrance system does not lead to the entrance system being kept in the opened state for long periods of time. Instead, the shorter keep open time is utilized as soon as the sensors does not detect anyone passing through the entrance system. Thus, less air infiltration is achieved even in situations with multiple people passing the entrance system during a singly opening cycle.

In one embodiment, the control arrangement 20 is further configured to in response to the sensor data obtained from the at least one sensor S1 . . . Sn indicating that a person or object is passing through the entrance system, control the automatic door operator 30 to cause the entrance system 10 to switch to the opened state OS if the entrance system is in the closing state CLS. This may be performed by means of the control arrangement 20 being configured to in response to receiving an active presence impulse from said at least one sensor S1 . . . Sn, control the automatic door operator 30 to cause the entrance system 10 to switch from the opened state OS if the entrance system is in the closing state CLS.

In one embodiment, at least one of the plurality of sensors S1 . . . Sn is configured to detect a person or object about to enter the entrance system 10 through the respective zone Z1 . . . Zn. The opening command may thus be generated in response to detection of a person or object about to enter the entrance system 10. In one embodiment, the at least one sensor being configured to detect a person or object about to enter the entrance system 10 may be at least one activity sensor. The at least one activity sensor is configured to monitor a zone representing an approach area of the entrance system. In one embodiment, at least one activity sensor is configured to monitor a zone representing an approach area of the entrance system on an inner side of the entrance system and at least one activity sensor is configured to monitor a zone representing an approach area of the entrance system on an outer side of the entrance system.

In one embodiment, the opening command is generated upon activation of a door operating switch operatively connected to the control arrangement 20. In one embodiment, the door operating switch may comprise a user interface for receiving input from a user.

In one embodiment, the opening command is generated externally and sent to the control arrangement or the controller of the control arrangement. In one embodiment, the control arrangement may be configured generate the opening command in response to above described sensor or activation of the door operation switch.

In one embodiment, the at least one sensor S1 . . . Sn which is configured to detect a person or object passing through the respective zone Z1 . . . Zn is further configured to detect at least one of the velocity and direction of the person or object passing through the respective zone Z1 . . . Zn. The second predetermined keep open time TK2 may thus be selected if the sensor data obtained from said sensor indicates that no person or object moves towards the entrance system 10. Thus, said at least one sensors allows for faster determination of a person or object having passed through the entrance system compared to a conventional binary presence sensor. The faster determination may cause a faster selection of the second keep open time, whereby the overall time the entrance system is in an opened state may be reduced further.

In one embodiment, the second predetermined keep open time TK2 is selected if the sensor data obtained from said at least one sensor S1 . . . Sn indicates that no person or object is present in the respective zone Z1 . . . Zn. Thus, conventional sensors may be utilized to provide the functionality for controlling the entrance system according to the present invention. Hence, a more cost-efficient entrance system may be achieved.

In one embodiment, the entrance system being a sliding door system 410, the one or more movable door members D1 . . . Dm being one or more sliding door members. Alternatively, the entrance system may be a swing door system 510, the one or more movable door members D1 . . . Dm being one or more swing door leafs.

According to an aspect a control arrangement 20 for the entrance system according to the present invention is provided. The control arrangement 20 for an entrance system 10 having one or more movable door members D1 . . . Dm and an automatic door operator 30 for causing movements of the one or movable door members between a closed position and an opened position corresponding to a closed state CS and an opened state OS of the entrance system 10, respectively. The control arrangement 20 comprises a controller 32 and at least one sensor S1 . . . Sn. Each sensor is connected to the controller 32 and configured to monitor a respective zone Z1 . . . Zn at the entrance system 10 for presence or activity of at least one person or object. The at least one sensor S1 . . . Sn is configured to detect a person or object passing through the entrance system 10 through the respective zone Z1 . . . Zn. Said at least one sensor is configured to generate an active presence impulse while a person or object is detected in the respective zone Z1 . . . Zn and an inactive presence impulse while no person or object is detected in said respective zone Z1 . . . Zn.

The entrance system 10 is configured to operate in an opening state OPS wherein the one or more movable door members D1 . . . Dm are moving between the closed position and the opened position towards the opened position and a closing state CLS wherein the one or more movable door members D1 . . . Dm are moving between the opened position and the closed position towards the closed position.

The control arrangement 20 is configured to receive an opening command prompting the entrance system to be in the opened state OS. In control the automatic door operator 30 to cause the entrance system 10 to switch to the opened state OS and select a first predetermined keep open time TK1 as a current keep open time TC for which the entrance system as a minimum shall be kept in the opened state OS.

In addition, the control arrangement 20 is configured to obtain sensor data from the at least one sensor S1 . . . Sn in response to the sensor data obtained from the at least one sensor S1 . . . Sn indicating that no person or object is passing through the entrance system, select a second predetermined keep open time TK2 as the current keep open time TC. Hence, the control arrangement 20 is configured to receive an active or inactive active presence impulse from the at least one sensor S1 . . . Sn configured to detect a person or object passing through the entrance system 10 through the respective zone Z1 . . . Zn. The second predetermined keep open time TK2 is substantially shorter than the first predetermined keep open time TK1.

The control arrangement is further configured to control the automatic door operator 30 to cause the entrance system 10 to switch from the opened state OS to the closing state CLS after the current keep open time TC if the sensor data obtained from the at least one sensor S1 . . . Sn indicates that no person or object is passing through the entrance system and no further opening commands are received. E.g., if the sensor data obtained from the at least one sensor S1 . . . Sn indicates that no person or object is passing through the entrance system and no additional opening commands are received during the current keep open time TC. Thus, the control arrangement 20 be configured to control the automatic door operator 30 to keep the entrance system (10) in the opened state OS for the current keep open time TC and if no active presence impulse and no opening command has been received during said current keep open time TC, cause the automatic door operator 30 to switch from the opened state OS to the closing state CS after said current keep open time TC.

Figure 4:
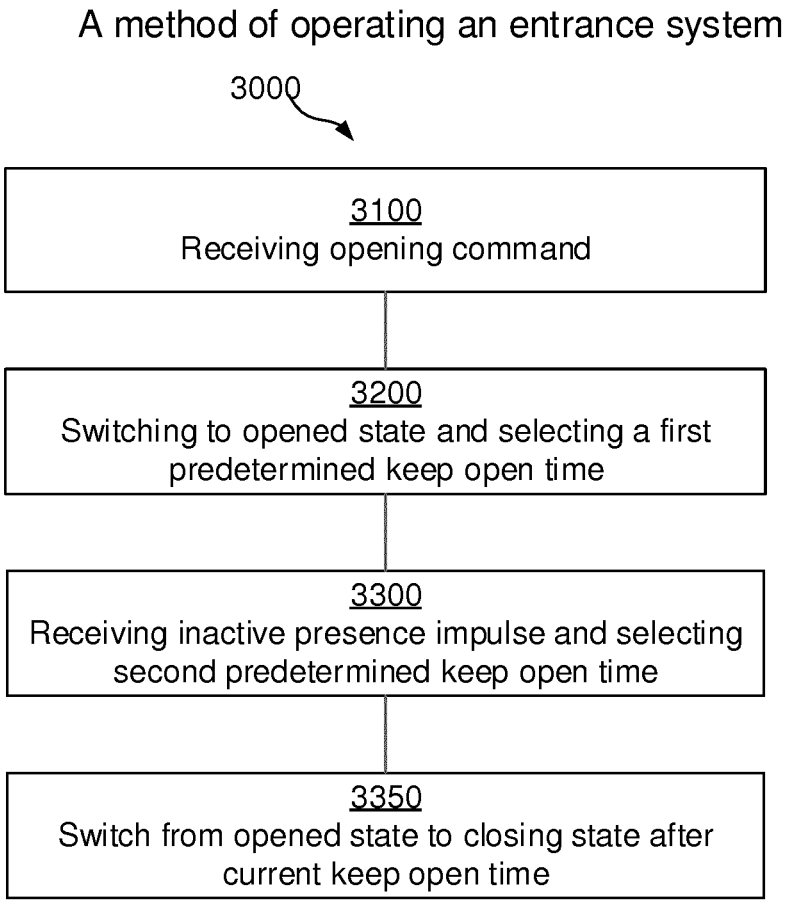
FIG. 4 is a flow chart diagram illustrating a method of operating an entrance system according to an embodiment.

Turning to FIG. 4, a method 3000 for operating the entrance system according to the present invention is depicted. The method may be initiated by a first step comprising receiving 3100 an opening command prompting the entrance system to be in the opened state OS.

In response to the opening command controlling 3200 the automatic door operator to cause the entrance system 10 to switch to the opened state OS and selecting a first predetermined keep open time TK1 as a current keep open time TC for which the entrance system as a minimum shall be kept in the opened state OS.

The method may further comprise obtaining sensor data from the at least one sensor S1 . . . Sn. In response to the sensor data obtained from the at least one sensor S1 . . . Sn indicating that no person or object is passing through the entrance system selecting a second predetermined keep open time TK2 as the current keep open time TC, the second predetermined keep open time TK2 being substantially shorter than the first predetermined keep open time TK1. Hence, the method may comprise receiving 3300 an active or inactive active presence impulse from the at least one sensor S1 . . . Sn configured to detect a person or object passing through the entrance system 10 through the respective zone Z1 . . . Zn and in response to receiving an inactive presence impulse, selecting the second predetermined keep open time TK2 as the current keep open time TC. The second predetermined keep open time TK2 is substantially shorter than the first predetermined keep open time TK1.

To initiate the closing of the door, the method may comprises controlling the automatic door operator 30 to cause the entrance system 10 to switch from the opened state OS to the closing state CLS after the current keep open time TC. This may be performed if the sensor data obtained from the at least one sensor S1 . . . Sn indicates that no person or object is passing through the entrance system and no further opening commands are received. E.g., if the sensor data obtained from the at least one sensor S1 . . . Sn indicates that no person or object is passing through the entrance system and no additional opening commands are received during the current keep open time TC. Worded differently, the method comprises controlling the automatic door operator 30 to keep the entrance system 10 in the opened state OS for the current keep open time TC and if no active presence impulse and no opening command has been received during said current keep open time TC, causing the automatic door operator 30 to switch 3350 from the opened state OS to the closing state CS after said current keep open time TC.

If an active presence impulse is received when the entrance system 10 is kept in the opened state OS during the current keep open time as described above. The method may further comprise causing the automatic door operator 30 to maintain the entrance system in the opened state OS while receiving the active presence impulse and in response to subsequently receiving an inactive presence impulse selecting the second predetermined keep open time TK2 as the current keep open time TC and subsequently causing the automatic door operator 30 to keep the entrance system 10 in the opened state OS for the current keep open time TC. If no active presence impulse and no opening command has been received during said current keep open time TC, the method may further comprise causing the automatic door operator 30 to switch from the opened state OS to the closing state CS after said current keep open time TC.

In one embodiment, the method may further comprise in response to the sensor data obtained from the at least one sensor S1 . . . Sn indicating that a person or object is passing through the entrance system, controlling the automatic door operator 30 to cause the entrance system 10 to switch to the opened state OS if the entrance system is in the closing state CLS. Hence, the method comprises in response to receiving an active presence impulse from the at least one sensor S1 . . . Sn, controlling the automatic door operator 30 to cause the entrance system 10 to switch to the opened state OS if the entrance system is in the closing state CLS.

In one embodiment, at least one of the plurality of sensors S1 . . . Sn is configured to detect a person or object about enter the entrance system 10 through the respective zone Z1 . . . Zn. The opening command is generated in response to detection of a person or object about to enter the entrance system 10.

In one embodiment, the opening command is generated upon activation of a door operating switch operatively connected to the control arrangement 20.

In one embodiment, the at least one sensor S1 . . . Sn configured to detect a person or object passing through the respective zone Z1 . . . Zn is further configured to detect at least one of the velocity and direction of the person or object passing through the respective zone Z1 . . . Zn. The second predetermined keep open time TK2 is selected if the sensor data obtained from said at least one sensor S1 . . . Sn indicates that no person or object moves towards the entrance system 10.

Figure 5:
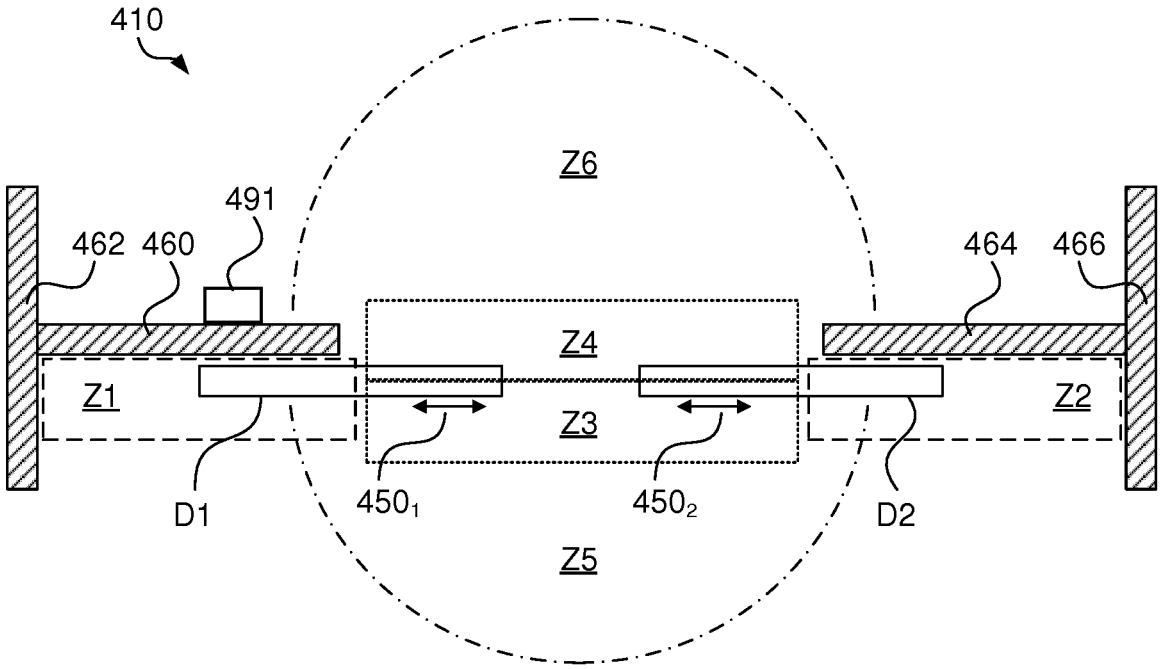
FIG. 5 is a schematic top view of an entrance system according to a first embodiment, in the form of a sliding door system.

Turning now to FIG. 5, a first embodiment of an entrance system according to the invention and implementing above described method. The entrance system 410 is in the form of a sliding door system 410 is shown in a schematic top view. The sliding door system 410 comprises first and second sliding doors or wings D1 and D2, being supported for sliding movements 4501 and 4502 in parallel with first and second wall portions 460 and 464. The first and second wall portions 460 and 464 are spaced apart; in between them there is formed an opening which the sliding doors D1 and D2 either blocks (when the sliding doors are in closed positions), or makes accessible for passage (when the sliding doors are in open positions). An automatic door operator (not seen in FIG. 5 but referred to as 30 in FIGS. 1 and 2) causes the movements 4501 and 4502 of the sliding doors D1 and D2.

Thus, the one or more movable door members D1 . . . Dm are sliding door members, i.e. the sliding door members D1 and D2. The sliding door members may be horizontally moving sliding door members.

With further reference to FIG. 5, each sliding door member D1 and D2 has an opened position, wherein the sliding door members are configured to be held as caused by the automatic door operator 30 for allowing access through the entrance system 10.

The sliding door system 410 comprises a plurality of sensors, each monitoring a respective zone Z1-Z6. The sensors themselves are not shown in FIG. 5, but they are generally mounted at or near ceiling level and/or at positions which allow them to monitor their respective zones Z1-Z6. To facilitate the reading, each sensor will be referred to as Sx in the following, where x is the same number as in the zone Zx it monitors (Sx=S1-S6, Zx=Z1-Z6).

A first sensor S1 is mounted at a lateral positon to the far left in FIG. 5 to monitor zone Z1. The first sensor S1 is a side presence sensor, and the purpose is to detect when a person or object occupies a space between the outer lateral edge of the sliding door D1 and an inner surface of a wall or other structure 462 when the sliding door D1 is moved towards the left in FIG. 5 during an opening state of the sliding door system 410. The provision of the side presence sensor S1 will help avoiding a risk that the person or object will be hit by the outer lateral edge of the sliding door D1, and/or jammed between the outer lateral edge of the sliding door D1 and the inner surface of the wall 462, by triggering abort and preferably reversal of the ongoing opening movement of the sliding door D1.

A second sensor S2 is mounted at a lateral positon to the far right in FIG. 5 to monitor zone Z2. The second sensor S2 is a side presence sensor, just like the first sensor S1, and has the corresponding purpose—i.e. to detect when a person or object occupies a space between the outer lateral edge of the sliding door D2 and an inner surface of a wall 466 when the sliding door D2 is moved towards the right in FIG. 5 during the opening state of the sliding door system 410.

A third sensor S3 is mounted at a first central positon in FIG. 5 to monitor zone Z3. The third sensor S3 is a door presence sensor, and the purpose is to detect when a person or object occupies a space between or near the inner lateral edges of the sliding doors D1 and D2 when the sliding doors D1 are moved towards each other in FIG. 5 during a closing state of the sliding door system 410. The provision of the sensor S3 will help avoiding a risk that the person or object will be hit by the inner lateral edge of the sliding door D1 or D2, and/or be jammed between the inner lateral edges of the sliding doors D1 and D2, by aborting and preferably reversing the ongoing closing movements of the sliding doors D1 and D2.

A fourth sensor S4 is mounted at a second central positon in FIG. 5 to monitor zone Z4. The fourth sensor S4, just like the third sensor S3, and has the corresponding purpose—i.e. to detect when a person or object occupies a space between or near the inner lateral edges of the sliding doors D1 and D2 when the sliding doors D1 are moved towards each other in FIG. 5 during a closing state of the sliding door system 410.

The side presence sensors S1 and S2 may for instance be active IR (infrared sensors). The sensors S3 and S4 may for instance be active IR (infrared) sensors, ultrasonic sensors, radar (microwave) sensors or time of flight sensors.

A fifth sensor S5 is mounted at an inner central positon in FIG. 5 to monitor zone Z5. The fifth sensor S5 is an inner activity sensor, and the purpose is to detect when a person or object approaches the sliding door system 410 from the inside of the premises. The provision of the inner activity sensor S5 will trigger the sliding door system 410, when being in a closed state or a closing state, to automatically switch to an opening state for opening the sliding doors D1 and D2, and then make another switch to an open state when the sliding doors D1 and D2 have reached their fully open positions.

A sixth sensor S6 is mounted at an outer central positon in FIG. 5 to monitor zone Z6. The sixth sensor S6 is an outer activity sensor, and the purpose is to detect when a person or object approaches the sliding door system 410 from the outside of the premises. Similar to the inner activity sensor S5, the provision of the outer activity sensor S6 will trigger the sliding door system 410, when being in its closed state or its closing state, to automatically switch to the opening state for opening the sliding doors D1 and D2, and then make another switch to an open state when the sliding doors D1 and D2 have reached their fully open positions.

The inner activity sensor S5 and the outer activity sensor S6 may for instance be active IR (infrared) sensors, ultrasonic sensors, radar (microwave) sensors or time of flight sensors.

According to present example, a person or object may be about to enter the entrance system 410 and passes through the zone Z6. The sensor S6 is configured to monitor said zone Z6 and thus detects said person or object. The control arrangement may be configured to cause the entrance system 410 to enter the opening state in response to detection of the person or object about to enter the entrance system 410. The opening command is generated in response to detection of the person or object about to enter the entrance system 410.

Alternatively or additionally, the sliding door system may utilize a manual triggering of the opening of the sliding door system which is activated by means of the user triggering the door operating switch 491. Hence, the opening command is generated in response to the activation of said door operating switch 491.

The sliding door system switches to an opening state from the closed state in response to the opening command. In response to the opening command the first predetermined keep open time TK1 is selected as the current keep open time TC for which the door blades D1 and D2 shall be in their open position, e.g. the sliding door system is in the open state.

Upon passing through the entrance system, the person will pass through the zone Z5 and Z3 and will eventually no longer be detectable by the sensor S5 monitoring the zone Z5 and the sensor S3 monitoring the zone Z3. In response to the sensor not detecting a person about to pass through the entrance system the sensor generates an inactive presence impulse, whereby the second keep open time TK2 is selected as the current keep open time TC. The sliding door system thus switches to the closing state after the current keep open time TC.

In the event of another person or object is detected before the siding door system reaches its closed state or the same person goes back towards the zone Z5 or Z3, an active presence impulse is generated by sensor S5 and/or S3 and the sliding door system may switch to the opening state. The sliding door system is kept in the opened state until an inactive sensor impulse is generated by S5 and/or S3, whereby the second predetermined keep open time is subsequently selected as the current keep open time and the sliding door system enters the closing state after said current keep open time. This cycle may be repeated continuously, e.g. for every detection of a person or object.

The sensor S6 may be configured to detect one or more properties of the person or object, i.e. the at least one person or object. As previously described said properties may include the velocity and/or direction of the person or object. This allows for detection of when a person or object is moving towards the entrance system. The system may thus be controlled based on data indicating that a person is about to enter the entrance system, whereby data indicating that a person or object present in the zone associated with the sensor is not moving towards the door does not cause the second keep open time to be selected. According to present example, the sensor S4 is a conventional outer activity sensor, however the functionality of detecting the properties of the at least one person or object may be implemented in a separate sensor instead, whereby said separate sensor also may be configured to monitor the zone Z6 or a zone similar to Z6. Thus, the control arrangement may comprise a separate activation sensor and a separate sensor for detecting said properties.

In order to ensure that the person or object does not risk to collide with the sliding door members D1 and D2 while entering the entrance system 410, the sensor S4 configured to monitor the zone Z4 representing a passage zone through the entrance system 410 is configured detect a person or object which moves through said zone Z4.

Accordingly, the control arrangement is configured to determine if the person or object entering through risks to collide with the sliding door members D1 and D2 based on the sensor input provided by the sensor S6 and control the automatic door operator so as to cause the entrance system 410 to switch from the closing state to the opening state in response to determining said risk. I.e. if such a risk has been identified, the control arrangement is configured to cause the entrance system to switch from the closing state to the opening state and select the second keep open time TK2 as the current keep open time TC.

Thereby, the sliding door members D1 and D2 will return towards their opened positions instead of risking a collision with the person or object passing through the entrance system 410.

It is further noted that all of the aforementioned applies analogously to at least one person or object about to enter through the entrance system through the zone Z3 and Z5 first, whereby the sensors S3 and S5 may be configured in a corresponding manner.

The movable door member may also be a vertically moving door member, i.e. a door member of a high-speed entrance system or high-speed door system. Thus the opened position corresponds to an elevated position of the movable door member and the closed position corresponds to a lowered position of the movable door member.

Figure 6:
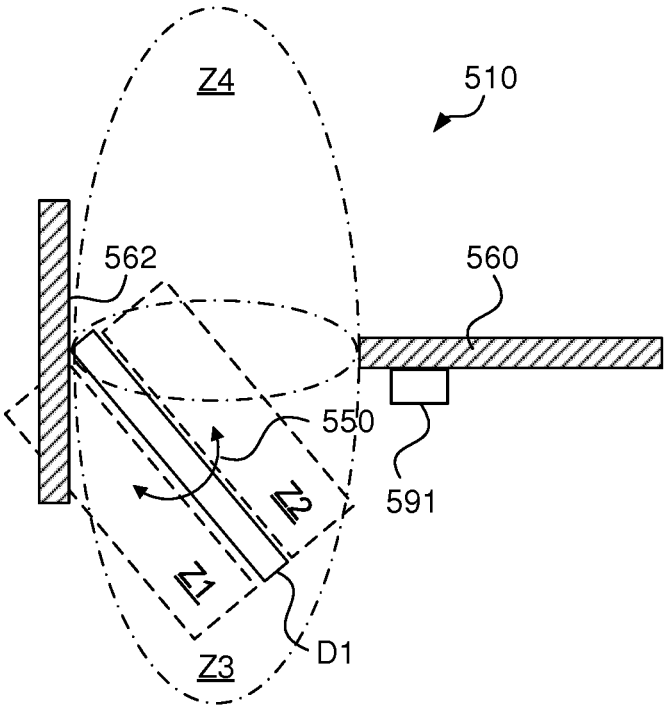
FIG. 6 is a schematic top view of an entrance system according to a second embodiment, in the form of a swing door system.

A second embodiment of an entrance system in the form of a swing door system 510 is shown in a schematic top view in FIG. 6. The swing door system 510 comprises a single swing door D1 being located between a lateral edge of a first wall 560 and an inner surface of a second wall 562 which is perpendicular to the first wall 560. The swing door D1 is supported for pivotal movement 550 around pivot points on or near the inner surface of the second wall 562. The first and second walls 560 and 562 are spaced apart; in between them an opening is formed which the swing door D1 either blocks (when the swing door is in closed position), or makes accessible for passage (when the swing door is in open position). An automatic door operator (not seen in FIG. 6 but referred to as 30 in FIGS. 1 and 2) causes the movement 550 of the swing door D1.

The swing door system 510 comprises a plurality of sensors, each monitoring a respective zone Z1-Z4. The sensors themselves are not shown in FIG. 6, but they are generally mounted at or near ceiling level and/or at positions which allow them to monitor their respective zones Z1-Z4. Again, each sensor will be referred to as Sx in the following, where x is the same number as in the zone Zx it monitors (Sx=S1-S4, Zx=Z1-Z4).

A first sensor S1 is mounted at a first central positon in FIG. 6 to monitor zone Z1. The first sensor S1 is a door presence sensor, and the purpose is to detect when a person or object occupies a space near a first side of the (door leaf of the) swing door D1 when the swing door D1 is being moved towards the open position during an opening state of the swing door system 510. The provision of the door presence sensor S1 will help avoiding a risk that the person or object will be hit by the first side of the swing door D1 and/or be jammed between the first side of the swing door D1 and the second wall 562; a sensor detection in this situation will trigger abort and preferably reversal of the ongoing opening movement of the swing door D1.

A second sensor S2 is mounted at a second central positon in FIG. 6 to monitor zone Z2. The second sensor S2 is a door presence sensor, just like the first sensor S1, and has the corresponding purpose—i.e. to detect when a person or object occupies a space near a second side of the swing door D1 (the opposite side of the door leaf of the swing door D1) when the swing door D1 is being moved towards the closed position during a closing state of the swing door system 510. Hence, the provision of the door presence sensor S2 will help avoiding a risk that the person or object will be hit by the second side of the swing door D1 and/or be jammed between the second side of the swing door D1 and the first wall 560; a sensor detection in this situation will trigger abort and preferably reversal of the ongoing closing movement of the swing door D1.

The sensors S1 and S2 may for instance be active IR (infrared) sensors, ultrasonic sensors, radar (microwave) sensors or time of flight sensors.

The sensors S1 and S2, e.g. the door presence sensors S1 and S2 may be mounted to a wall above the entrance system or directly mounted to the swing door blade D1 as depicted in FIG. 6.

A third sensor S3 is mounted at an inner central positon in FIG. 6 to monitor zone Z3. The third sensor S3 is an inner activity sensor, and the purpose is to detect when a person or object approaches the swing door system 510 from the inside of the premises. The provision of the inner activity sensor S3 will trigger the sliding door system 510, when being in a closed state or a closing state, to automatically switch to an opening state for opening the swing door D1, and then make another switch to an open state when the swing door D1 has reached its fully open position.

A fourth sensor S4 is mounted at an outer central positon in FIG. 6 to monitor zone Z4. The fourth sensor S4 is an outer activity sensor, and the purpose is to detect when a person or object approaches the swing door system 510 from the outside of the premises. Similar to the inner activity sensor S3, the provision of the outer activity sensor S4 will trigger the swing door system 510, when being in its closed state or its closing state, to automatically switch to the opening state for opening the swing door D1, and then make another switch to an open state when the swing door D1 has reached its fully open position.

The inner activity sensor S3 and the outer activity sensor S4 may for instance be active IR (infrared) sensors, ultrasonic sensors, radar (microwave) sensors or time of flight sensors.

According to present example, a person or object may be about to enter the entrance system 410 through the zone Z4. The sensor S4 is configured to monitor said zone Z4 and thus detects said person or object. The control arrangement may be configured to cause the entrance system 510 to enter the opening state in response to detecting the person or object about to enter the entrance system through the zone Z4. The opening command is generated in response in response to detection of the person or object about to enter the entrance system 510.

Alternatively or additionally, the swing door system may utilize a manual triggering of the opening of the swing door system which is activated by means of the user triggering the door operating switch 591. Hence, the opening command is generated in response to the activation of said door operating switch 591.

The swing door system switches to an opening state from the closed state in response to the opening command. In response to the opening command the first predetermined keep open time TK1 is selected as the current keep open time TC for which the door blades D1 shall be in their open position, e.g. the swing door system is in the open state.

Upon passing through the entrance system, the person will pass through the zone Z5 and Z3 and will eventually no longer be detectable by the sensor S5 monitoring the zone Z5 and the sensor S3 monitoring the zone Z3. In response to the sensor not detecting a person about to pass through the entrance system, the sensor S3 and/or S5 is generates an inactive presence sensor impulse, whereby the second keep open time TK2 is selected as the current keep open time TC. The sliding door system thus switches to the closing state after the current keep open time TC.

In the event of another person or object is detected before the swing door system reaches its closed state or the same person goes back towards the zone Z5 or Z3, an active presence impulse is generated by the sensor S1 and/or S2 and the swing door system may switch to the opening state. The swing door system is kept in the opened state until an inactive sensor impulse is generated by S1 and/or S2, whereby the second predetermined keep open time is subsequently selected as the current keep open time and the swing door system enters the closing state after said current keep open time This cycle may be repeated continuously, e.g. for every detection of a person or object, the keep open time may be set as the first keep open time and upon no detection of a person object the keep open time is set to the second keep open time TK2.

The sensor S4 may be configured to detect one or more properties of the person or object, i.e. the at least one person or object. As previously described said properties may include the velocity and/or direction of the person or object. This allows for detection of when a person or object is moving towards the entrance system. The system may thus be controlled based on data indicating that a person is about to enter the entrance system, whereby data indicating that a person or object present in the zone associated with the sensor is not moving towards the door does not cause the second keep open time to be selected.

According to present example, the sensor S4 is a conventional outer activity sensor, however the functionality of detecting the properties of the at least one person or object may be implemented in a separate sensor instead, whereby said separate sensor also may be configured to monitor the zone Z4 or a zone similar to Z4. Thus, the control arrangement may comprise a separate activation sensor and a separate sensor for detecting said properties.

In order to ensure that the person or object does not risk to collide with the swing door member D1 while entering the entrance system 510, the sensor S2 configured to monitor the zone Z2 representing a passage zone through the entrance system 510 is configured detect a person or object which moves through said zone Z2.

Accordingly, the control arrangement is configured to determine if the person or object entering through risks to collide with the swing door leaf D1 based on the sensor input provided by the sensor S2 and control the automatic door operator so as to cause the entrance system 510 to switch from the closing state to the opening state in response to determining said risk. I.e. if such a risk has been identified, the control arrangement is configured to cause the entrance system to switch from the closing state to the opening state and select the second keep open time TK2 as the current keep open time TC.

Thereby, the swing door leaf D1 will return towards its opened positions instead of risking a collision with the person or object passing through the entrance system 510.

It is further noted that all of the aforementioned applies analogously to at least one person or object about to enter through the entrance system through the zone Z3 and Z1 first, whereby the sensors S1 and S3 may be configured in a corresponding manner.

The invention has been described above in detail with reference to embodiments thereof. However, as is readily understood by those skilled in the art, other embodiments are equally possible within the scope of the present invention, as defined by the appended claims.

The invention claimed is:

1. An entrance system comprising:

one or more movable door members;

an automatic door operator for causing movements of the one or more movable door members between a closed position and an opened position corresponding to a closed state (CS) and an opened state (OS) of the entrance system, respectively;

a control arrangement for controlling the automatic door operator, wherein the control arrangement comprises a controller and at least one sensor, each sensor being connected to the controller and being configured to monitor a respective zone at the entrance system for presence or activity of a person or object, wherein the at least one sensor is configured to detect the person or object passing through the entrance system through the respective zone and said at least one sensor is configured to generate an active presence impulse while the person or object is detected in the respective zone and an inactive presence impulse while no person or object is detected in said respective zone; wherein the entrance system is configured to operate in an opening state (OPS) wherein the one or more movable door members are moving between the closed position and the opened position towards the opened position and a closing state (CLS) wherein the one or more movable door members are moving between the opened position and the closed position towards the closed position; wherein the control arrangement is configured to:

receive an opening command prompting the entrance system to be in the opened state (OS);

in response to the opening command, control the automatic door operator to cause the entrance system to switch to the opened state (OS) and select a first predetermined keep open time (TK1) as a current keep open time (TC) for which the entrance system shall be kept in the opened state (OS);

receive the active or inactive presence impulse from the at least one sensor configured to detect the person or object passing through the entrance system through the respective zone;

in response to receiving the inactive presence impulse, select a second predetermined keep open time (TK2) as the current keep open time (TC), the second predetermined keep open time (TK2) being shorter than the first predetermined keep open time (TK1); and control the automatic door operator to keep the entrance system in the opened state (OS) for the current keep open time (TC) and if no active presence impulse and no opening command has been received during said current keep open time (TC), cause the automatic door operator to switch from the opened state (OS) to the closing state (CS) after said current keep open time (TC).

2. The entrance system according to claim 1, wherein if the active presence impulse is received when the entrance system is kept in the opened state (OS) during the current keep open time (TC), the control arrangement is configured to cause the automatic door operator to maintain the entrance system in the opened state (OS) while receiving said active presence impulse and in response to subsequently receiving the inactive presence impulse select the second predetermined keep open time (TK2) as the current keep open time (TC) and subsequently cause the automatic door operator to keep the entrance system in the opened state (OS) for the current keep open time (TC) and if no active presence impulse and no opening command has been received during said current keep open time (TC), cause the automatic door operator to switch from the opened state (OS) to the closing state (CS) after said current keep open time (TC).

3. The entrance system according to claim 1, wherein the control arrangement is further configured to in response receiving the active presence impulse from the at least one sensor, control the automatic door operator to cause the entrance system to switch to the opened state (OS) if the entrance system is in the closing state (CLS).

4. The entrance system according to claim 1, wherein at least one of the plurality of sensors is configured to detect the person or object about to enter the entrance system through the respective zone, wherein the opening command is generated in response to detection of the person or object about to enter the entrance system.

5. The entrance system according to claim 1, wherein the opening command is generated upon activation of a door operating switch operatively connected to the control arrangement.

6. The entrance system according to claim 1, the entrance system being a sliding door system, the one or more movable door members being one or more sliding door members.

7. The entrance system according to claim 1, the entrance system being a swing door system, the one or more movable door members being one or more swing door leafs.

8. A control arrangement for an entrance system having one or more movable door members and an automatic door operator for causing movements of the one or more movable door members between a closed position and an opened position corresponding to a closed state (CS) and an opened state (OS) of the entrance system, respectively, the control arrangement comprising:

a controller; and at least one sensor, each sensor being connected to the controller and being configured to monitor a respective zone at the entrance system for presence or activity of a person or object, wherein the at least one sensor is configured to detect the person or object passing through the entrance system through the respective zone and said at least one sensor is configured to generate an active presence impulse while the person or object is detected in the respective zone and an inactive presence impulse while no person or object is detected in said respective zone;

wherein the entrance system is configured to operate in an opening state (OPS) wherein the one or more movable door members are moving between the closed position and the opened position towards the opened position and a closing state (CLS) wherein the one or more movable door members are moving between the opened position and the closed position towards the closed position; wherein the control arrangement is configured to:

receive an opening command prompting the entrance system to be in the opened state (OS);

in response to the opening command, control the automatic door operator to cause the entrance system to switch to the opened state (OS) and select a first predetermined keep open time (TK1) as a current keep open time (TC) for which the entrance system shall be kept in the opened state (OS);

receive the active or inactive presence impulse from the at least one sensor configured to detect the person or object passing through the entrance system through the respective zone;

in response to receiving the inactive presence impulse, select a second predetermined keep open time (TK2) as the current keep open time (TC), the second predetermined keep open time (TK2) being shorter than the first predetermined keep open time (TK1); and control the automatic door operator to keep the entrance system in the opened state (OS) for the current keep open time (TC) and if no active presence impulse and no opening command has been received during said current keep open time (TC), cause the automatic door operator to switch from the opened state (OS) to the closing state (CS) after said current keep open time (TC).

9. A method of operating an entrance system having one or more movable door members and an automatic door operator for causing movements of the one or more movable door members between a closed position and an opened position corresponding to a closed state (CS) and an opened state (OS) of the entrance system, respectively, wherein the entrance system is further configured to operate in an opening state wherein the one or more movable door members are moving between the closed position and the opened position towards the opened position and a closing state (CLS) wherein the one or more movable door members are moving between the opened position and the closed position towards the closed position, wherein the entrance system comprises a control arrangement for controlling the automatic door operator, wherein the control arrangement comprises a controller and at least one sensor, each sensor being connected to the controller and being configured to monitor a respective zone at the entrance system for presence or activity of a person or object, wherein the at least one sensor is configured to detect the person or object passing through the entrance system through the respective zone and said at least one sensor is configured to generate an active presence impulse while the person or object is detected in the respective zone and an inactive presence impulse while no person or object is detected in said respective zone, the method comprising:

receiving an opening command prompting the entrance system to be in the opened state (OS);

in response to the opening command controlling the automatic door operator to cause the entrance system to switch to the opened state (OS) and selecting a first predetermined keep open time (TK1) as a current keep open time (TC) for which the entrance system shall be kept in the opened state (OS);

receiving the active or inactive active presence impulse from the at least one sensor configured to detect the person or object passing through the entrance system through the respective zone;

in response to receiving the inactive presence impulse, selecting a second predetermined keep open time (TK2) as the current keep open time (TC), the second predetermined keep open time (TK2) being shorter than the first predetermined keep open time (TK1); and controlling the automatic door operator to keep the entrance system in the opened state (OS) for the current keep open time (TC) and if no active presence impulse and no opening command has been received during said current keep open time (TC), causing the automatic door operator to switch from the opened state (OS) to the closing state (CS) after said current keep open time (TC).

10. The method according to claim 9, wherein if the active presence impulse is received when the entrance system is kept in the opened state (OS) during the current keep open time (TC), the method further comprises causing the automatic door operator to maintain the entrance system in the opened state (OS) while receiving said active presence impulse and in response to subsequently receiving the inactive presence impulse selecting the second predetermined keep open time (TK2) as the current keep open time (TC) and subsequently causing the automatic door operator to keep the entrance system in the opened state (OS) for the current keep open time (TC) and if no active presence impulse and no opening command has been received during said current keep open time (TC), causing the automatic door operator to switch from the opened state (OS) to the closing state (CS) after said current keep open time (TC).

11. The method according to claim 9, further comprising in response to receiving the active presence impulse from the at least one sensor, controlling the automatic door operator to cause the entrance system to switch to the opened state (OS) if the entrance system is in the closing state (CLS).

12. The method according to claim 9, wherein at least one of the plurality of sensors is configured to detect the person or object about enter the entrance system through the respective zone, wherein the opening command is generated in response to detection of the person or object about to enter the entrance system.

13. The method according to claim 9, wherein the opening command is generated upon activation of a door operating switch operatively connected to the control arrangement.

* * * * *